US006733246B2

(12) United States Patent
Imai et al.

(10) Patent No.: US 6,733,246 B2
(45) Date of Patent: May 11, 2004

(54) CONTROL DEVICE FOR VARIABLE DISPLACEMENT TYPE COMPRESSOR

(75) Inventors: Takayuki Imai, Kariya (JP); Tatsuya Koide, Kariya (JP); Masakazu Murase, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/367,561

(22) Filed: Feb. 14, 2003

(65) Prior Publication Data

US 2003/0154731 A1 Aug. 21, 2003

(51) Int. Cl.[7] ..... F25B 1/00; F04B 1/26
(52) U.S. Cl. ..... 417/222.2; 62/228.3
(58) Field of Search ..... 417/222.2; 62/228.3, 62/228.5

(56) References Cited

U.S. PATENT DOCUMENTS

| | | | | |
|---|---|---|---|---|
| 6,074,173 A | | 6/2000 | Taguchi | 417/222.2 |
| 6,517,323 B2 | | 2/2003 | Kimura et al. | 417/222.2 |
| 6,662,581 B2 | * | 12/2003 | Hirota et al. | 62/228.3 |
| 2003/0044291 A1 | * | 3/2003 | Umemura et al. | 417/222.2 |

FOREIGN PATENT DOCUMENTS

| | | | |
|---|---|---|---|
| EP | 0 947 695 A2 | 10/1999 | F04B/27/18 |
| EP | 0 947 695 A3 | 2/2000 | F04B/27/18 |
| EP | 1 070 845 A1 | 1/2001 | F04B/27/08 |
| JP | 06-108970 | 4/1994 | F04B/27/08 |
| JP | 09-228957 | 9/1997 | F04B/49/00 |
| JP | 10-61549 | 3/1998 | F04B/27/14 |
| JP | 11-201054 | 7/1999 | F04B/49/08 |
| JP | 11-241680 | 9/1999 | F04B/27/14 |

* cited by examiner

*Primary Examiner*—William Wayner
(74) *Attorney, Agent, or Firm*—Morgan & Finnegan, LLP

(57) ABSTRACT

A control device includes a first passage, a second passage, a third passage, a displacement control valve and an auxiliary valve. The displacement control valve is placed in the first passage. The auxiliary valve includes a valve chamber, a spool valve and an urging means. The spool valve is slidably accommodated in the valve chamber. The spool valve divides the valve chamber into a first pressure chamber and a second pressure chamber, to communicate the first pressure chamber with the first passage and to communicate the second pressure chamber with the second passage. The urging means is placed in the valve chamber for urging the spool valve toward the first pressure chamber. The third passage communicates with the first pressure chamber and/or the second pressure chamber by the movement of the spool valve.

14 Claims, 6 Drawing Sheets

CONTROL DEVICE FOR VARIABLE DISPLACEMENT TYPE COMPRESSOR

BACKGROUND OF THE INVENTION

The present invention relates to a control device, for example, that constitutes a refrigerant circuit in a vehicle air conditioning apparatus, the control device controlling displacement of a variable displacement type compressor that is capable of varying the displacement based on pressure in a control chamber.

This type of control device includes a supply passage, a blood passage and a displacement control valve, for example, for a variable displacement swash plate type compressor (hereinafter a compressor). In the compressor, a crank chamber and a discharge chamber are in communication via the supply passage. The crank chamber and a suction chamber are in communication via the bleed passage. The displacement control valve adjusts an opening degree of the supply passage in accordance with cooling load. That is, controlling the displacement of the compressor is performed by a supply control.

Under the supply control, a fixed throttle is placed in the bleed passage to reduce an amount of the compressed refrigerant gas that leaks into the suction chamber through the crank chamber, namely, to prevent efficiency of a refrigerating cycle from deteriorating due to re-expansion of the leaked refrigerant gas in the suction chamber. Therefore, in a state that liquid refrigerant accumulates in the crank chamber, if the compressor, is started, the liquid refrigerant is relatively slowly discharged out of the crank chamber through the bleed passage by the fixed throttle. At the same time, a large amount of the liquid refrigerant in the crank chamber is vaporized and the pressure in the crank chamber excessively rises. Thereby, it requires relatively long time to increase the displacement of the compressor to a predetermined level after the displacement control valve closes the supply passage, in other words, starting performance of the air conditioning apparatus deteriorates.

To solve the above problem, the following structure is considered. As shown in FIGS. 8A and 8B, a crank chamber 101 and a suction chamber 102 are not only in communication via the above-mentioned bleed passage or a first bleed passage but also in communication via a second bleed passage 103. An auxiliary valve 104 is placed in the second bleed passage 103. The auxiliary valve 104 opens and closes second bleed passage 103 by moving the spool valve 104*b* relative to the valve seat 104*a*.

Still referring to FIGS. 8A and 8B, the spool valve 104*b* is urged to leave the valve seat 104*a* by a spring 104*c*. The pressure in the crank chamber 101 is applied to the spool valve 104*b* such that the spool valve 104*b* leaves the valve seat 104*a*. The refrigerant between a displacement control valve 106 and a fixed throttle 105*a* in the supply passage 105 is introduced into a back pressure chamber 104*d* of the auxiliary valve 104. That is, a position of the spool valve 104*b* is determined based on a balance between urging force of the spring 104*c*, the force that is generated due to the pressure in the crank chamber 101 and the force that is generated due to the pressure in the back pressure chamber 104*d*.

In the above constitution, if the compressor is started in a state that the liquid refrigerant accumulates in the crank chamber 101, the liquid refrigerant is vaporized. Even if the displacement control valve 106 is fully closed, the pressure in the crank chamber 101 tends to excessively rise. When the displacement control valve 106 is fully closed, on the other hand, high-pressure refrigerant in the discharge chamber 107 is not supplied to the back pressure chamber 104*d* of the auxiliary valve 104. Therefore, the pressure in the back pressure 104*d* becomes relatively small.

In this case, as shown in FIG. 8B, the spool valve 104*b* of the auxiliary valve 104 is left from the valve seat 104*a* by the urging force of the spring 104*c* and the second bleed passage 103 is opened. Therefore, the liquid refrigerant in the crank chamber 101 is discharged to the suction chamber 102 through the second bleed passage 103 in its vaporized state and/or its liquid state. Thus, when the displacement control valve 106 is fully closed, the pressure in the crank chamber 101 is promptly reduced. Thereby, the displacement of the compressor is promptly increased.

If the air conditioning apparatus is started and the temperature in the vehicle compartment is lowered to a predetermined temperature, the displacement control valve 106 is opened. At this time, the high-pressure refrigerant in the discharge chamber 107 is introduced into the back pressure chamber 104*d* of the auxiliary valve 104. Therefore, the pressure in the back pressure chamber 104*d* rises and, as shown in FIG. 8A, the spool valve 104*b* contacts the valve seat 104*a* against the spring 104*c*. Thereby, the crank chamber 101 and the suction chamber 102 are blocked. Consequently, not only an amount of the compressed refrigerant gas, which is supplied from the discharge chamber 107 to the crank chamber 101, is reduced but also an amount of the compressed refrigerant gas, which is supplied from the crank chamber 101 to the suction chamber 102, is reduced, and deterioration of efficiency refrigerating cycle is prevented.

In the above constitution, which is shown in FIGS. 8A and 8B, the auxiliary valve 104 opens and closes the second bleed passage 103 by moving the spool valve 104*b* relative to the valve seat 104*a*. Therefore, for example, if the compressor vibrates under the movement of the vehicle, the spool valve 104*b* that is in contact with the valve seat 104*a* leaves the valve seat 104*a* and the second blood passage 103 is opened. Thereby, controlling the displacement of the compressor is unstable.

SUMMARY OF THE INVENTION

The present invention is directed to a control device for use in a variable displacement type compressor where satisfactory starting performance of an air conditioning apparatus is compatible with stability of controlling displacement of the compressor at high level.

The present invention has a following feature. A control device controls displacement of a variable displacement type compressor for an air conditioning apparatus. The compressor has a suction pressure region, a discharge pressure region and a crank chamber in a housing. The displacement is variable according to the pressure in the crank chamber. The control devise includes a first passage, a second passage, a third passage, a displacement control valve and an auxiliary valve. The first passage is defined in the housing and communicates with the discharge pressure region. The second passage is defined in the housing and communicates with the suction pressure region. The third passage is defined in the housing and communicates with the crank chamber. The displacement control valve is placed in the first passage for adjusting an opening degree of the first passage. The auxiliary valve is placed between the suction pressure region and the crank chamber in the housing and connect the first passage and the second passage to the third passage. The auxiliary valve has a valve chamber, a spool valve and an urging means. The valve chamber is defined in the housing. The valve chamber has an inner surface. The spool valve is accommodated in the valve chamber so as to slide relative to the inner surface, on which the third passage is open. The spool valve divides the valve chamber into a first pressure chamber and a second pressure chamber, to communicate the first pressure chamber with the first passage and to communicate the second pressure chamber with the second passage. The urging means is placed in the valve chamber for urging the spool valve toward the first pressure chamber. The third passage communicates with the first pressure chamber and/or the second pressure chamber by the movement of the spool valve due to the differential pressure between the first pressure chamber and the second pressure chamber, which varies in accordance with the opening degree of the first passage.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
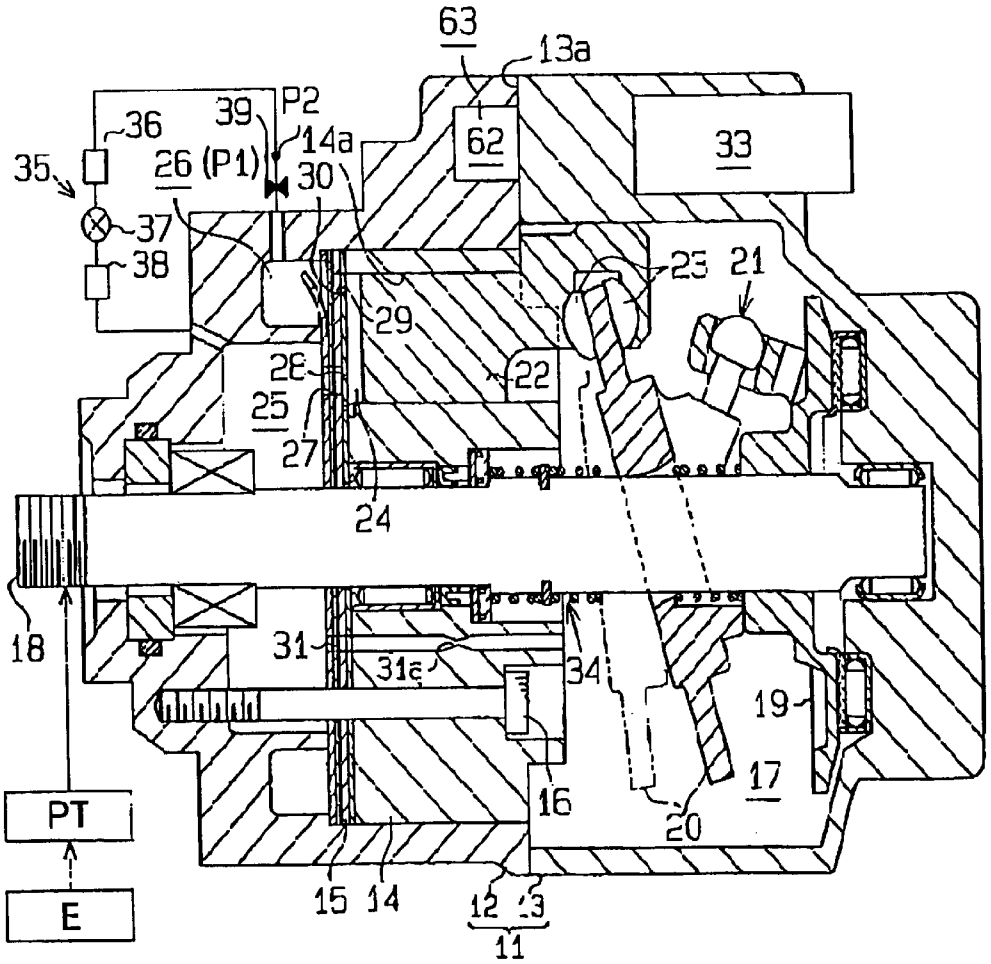
FIG. 1 is a longitudinal cross-sectional view illustrating a variable displacement swash plate type compressor according to a preferred embodiment of the present invention.

A control device of a variable displacement swash plate type compressor for use in a vehicle air conditioning apparatus according to a preferred embodiment of the present invention will be described with reference to FIGS. 1 through 3.

To begin with, the variable displacement swash plate type compressor (hereinafter a compressor) will now be described with reference to FIG. 1. A left side of FIG. 1 is front side and a right side of FIG. 1 is rear side. A housing 11 of the compressor includes a front housing 12 and a rear housing 13 each as a housing component. The front housing 12 and the front housing 13 are fixedly joined to each other by a plurality of through bolts, which is not illustrated. A cylinder block 14 is placed in a space defined between the front housing 12 and the rear housing 13 such that the cylinder block 14 is inserted in the space on the side of the front housing 12. A valve plate assembly 15 is interposed between the front housing 12 and the front side of the cylinder block 14. The cylinder block 14 and the valve plate assembly 15 are fixed to the front housing 12 by a bolt 16.

Still referring to FIG. 1, a crank chamber 17 as a control chamber is defined in the rear housing 13. A drive shaft 18 is supported for rotation in the crank chamber 17 by the front housing 12, the cylinder block 14 and the rear housing 13. The drive shaft 18 is operatively connected to an engine E as a vehicle drive source through a power transmission mechanism PT to receive power, thereby receiving power and being rotated. In the present preferred embodiment, the power transmission mechanism PT is a clutchless type mechanism where the engine E is continuously connected to the compressor, for example, having a belt and a pulley.

In the crank chamber 17, a lug plate 19 is fixedly mounted to the drive shaft 18 to integrally rotate with the drive shaft 18. A swash plate 20 is supported by the drive shaft 18 in the crank chamber 17 so as to slide relative to the drive shaft 18 and incline to a rotary axis of the drive shaft 18. A hinge mechanism 21 is interposed between the lug plate 19 and the swash plate 20. Thereby, the swash plate 20 is synchronously rotated with the lug plate 18 and the drive shaft 18 while inclining relative to the rotary axis of the drive shaft 18.

The cylinder block 14 has a plurality of cylinder bores 14*a*, although only one cylinder bore 14*a* is illustrated in FIG. 1. A single-head piston 22 (hereinafter a piston) is accommodated in each cylinder bore 14*a* for reciprocation. Each piston 22 is engaged with an outer periphery of the swash plate 20 through a pair of shoes 23. Therefore, the rotary motion of the drive shaft 18 is converted to reciprocating motion of each piston 22 through the swash pate 20 and the shoes 23.

In the front side of each cylinder bore 14*a*, a compression chamber 24 is defined between the valve plate assembly 15 and the corresponding piston 22. A suction chamber 25 as a suction pressure region and a discharge chamber 26 as a discharge pressure region are each defined between the front housing 12 and the valve plate assembly 15.

Refrigerant gas in the suction chamber 25 is drawn into the compression chamber 24 through a suction port 27 formed on the valve plate assembly 15 by pushing a suction valve 28 formed on the valve plate assembly 15 in accordance with the movement of the piston 22 from a top dead center to a bottom dead center thereof. The refrigerant gas that is drawn into the compression chamber 24 is compressed to a predetermined pressure and is discharged to the discharge chamber 26 through a discharge port 29 formed on the valve plate assembly 15 by pushing a discharge valve 30 formed on the valve plate assembly 15 in accordance with the movement of the piston 22 from the bottom dead center to the top dead center thereof.

The control device of the compressor will now be described with reference to FIGS. 1 and 2 in the housing 11 of the compressor, a first bleed passage 31 and a supply passage 32 are formed. The crank chamber 17 and the suction chamber 25 are in communication via the first bleed passage 31. A fixed throttle 31*a* is placed in the first bleed passage 31. The discharge chamber 26 and the crank chamber 17 are in communication via the supply passage 32. A displacement control valve 33 is placed in the supply passage 32 near the outer periphery of the rear housing 13.

Relatively high-pressure discharge gas in the discharge chamber 26 flows into the crank chamber 17 through the supply passage 32 while gas in the crank chamber 17 flows out of the crank chamber 17 through the first bleed passage 31. The balance between the amount of gas flowing into and out of the crank chamber 17 is controlled by varying an opening degree of the supply passage 32 in the displacement control valve 33 in accordance with cooling load. Thereby, the pressure in the crank chamber 17 is determined. In accordance with the variation of the pressure in the crank chamber 17, the differential pressure between the crank chamber 17 and the compression chamber 24 applied to the piston 22 is varied. Thereby, the inclination angle of the swash plate 20 relative to the plane perpendicular to the rotary axis of the drive shaft 18 is varied. Consequently, a stroke distance of the piston 22, namely, displacement of the compressor is adjusted.

For example, as the pressure in the crank chamber 17 decreases the inclination angle of the swash plate 20 increases, thereby increasing the displacement of the compressor. When the inclination of the swash plate 20 is regulated by the contact between the rear surface of the swash plate 20 and the front surface of the lug plate 19, as indicated by a solid line shown in FIG. 1, the swash plate 20 is at a maximum inclination angle.

On the contrary, as the pressure in the crank chamber 17 increases, the inclination angle of the swash plate 20 decreases, thereby decreasing the displacement of the compressor. When the inclination of the swash plate 20 is regulated by a spring 34 mounted around the drive shaft 18 as a means for regulating a minimum inclination angle of the swash plate 20, as indicated by a two-dot chain line shown in FIG. 1, the swash plate 20 is at a minimum inclination angle.

A refrigerant circuit will now be described with reference to FIG. 1. The refrigerant circuit or a refrigerating cycle for the vehicle air conditioning apparatus includes the above-described compressor and an external refrigerant circuit 35. The external refrigerant circuit 35 includes a condenser 36, an expansion valve 37 and an evaporator 38.

Figure 2:
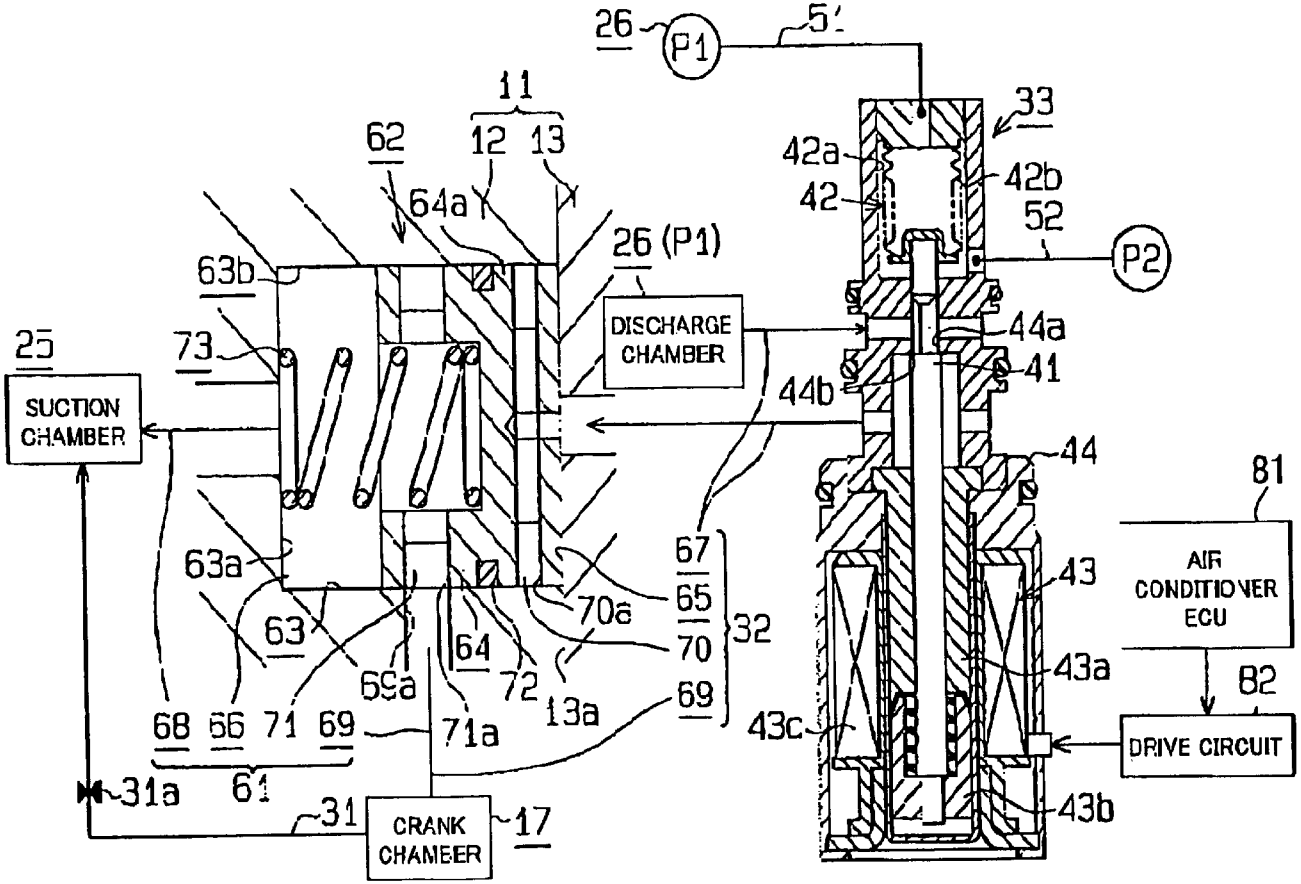
FIG. 2 is a longitudinal cross-sectional view illustrating a state of a displacement control valve and an auxiliary valve for use in a control device for the variable displacement swash plate type compressor according to the preferred embodiment of the present invention.

As shown in FIG. 2, a first pressure monitoring point P1 is set in the discharge chamber 26. A second pressure monitoring point P2 is separated by a predetermined distance from the first pressure monitoring point P1 toward the condenser 36 in a refrigerant passage. A throttle 39 is placed between the first pressure monitoring point P1 and the second pressure monitoring point P2 in the refrigerant passage. Therefore, a flow rate of the refrigerant discharged into the refrigerant circuit is reflected on the differential pressure between the first pressure monitoring point P1 and the second pressure monitoring point P2.

As shown in FIG. 2, the first monitoring point P1 and the displacement control valve 33 are in communication via a first pressure detecting passage 51. The second monitoring point P2 and the displacement control valve 33 are in communication via a second pressure detecting passage 52.

The displacement control valve 33 will now be described with reference to FIG. 2. The displacement control valve 33 has a valve body 41, a pressure sensing mechanism 42, an eletromagnetic actuator 43 and a valve housing 44. The valve body 41 adjusts the opening degree of the supply passage 32. The pressure sensing mechanism 42 is operatively connected to the valve body 41 on the upside in FIG. 2. The electromagnetic actuator 43 is operatively connected to the valve body 41 on the downside in FIG. 2. The valve body 41, the pressure sensing mechanism 42 and the electromagnetic actuator 43 are provided in the valve housing 44. A valve hole 44*a* is formed for constituting a part of the supply passage 32 in the valve housing 44. The valve housing 44 forms a valve seat 44*b* therein at an opening end of the valve hole 44*a*. As the valve body 41 moves downward in FIG. 2 and leaves the valve seat 44*b*, an opening degree of the valve hole 44*a* increases. In contrast, as the valve body 41 moves upward in FIG. 2 and approaches the valve seat 44*b*, the opening degree of the valve hole 44*a* decreases.

The pressure sensing mechanism 42 includes a pressure sensing chamber 42*a* and a bellows 42*b*. The pressure sensing chamber 42*a* is formed upward in the valve housing 44 shown in FIG. 2. The bellows 42*b* as a pressure sensing member is accommodated in the pressure sensing chamber 42*a*. In the pressure sensing chamber 42*a*, the refrigerant having the pressure at the first pressure monitoring point P1 is introduced to the inside of the bellows 42*b* through the first pressure detecting passage 51. In the pressure sensing chamber 42*a*, the refrigerant having the pressure at the second pressure monitoring point P2 is introduced to the outside of the bellows 42*b* through the second pressure detecting passage 52.

The electromagnetic actuator 43 includes a stationary core 43*a*, a movable core 43*b* and a coil 43*c*. The valve body 41 is operatively connected to the movable core 43*b*. A drive circuit 82 supplies the coil 43*c* with electricity in accordance with cooling load based on a command of the air conditioner ECU (Electronic Control Unit) 81 as a controlling computer. Electromagnetic force is generated between the stationary core 43*a* and the movable core 43*b* in accordance with the magnitude of the electricity supplied from the drive circuit 82 to the coil 43*c*. Thereby, the movable core 43*b* is attracted to the stationary core 43*a*. Thus, the electromagnetic force is transmitted to the valve body 41 through the movable core 43*b*. The magnitude of the electricity supplied to the coil 43*c* is controlled by adjusting a voltage applied to the coil 43*c*. A pulse width modulation control or a PWM control is adopted to adjust the applied voltage.

A characteristic operation of the above-described displacement control valve 33 will now be described with reference to FIG. 2. In the displacement control valve 33, a position of the valve body 41 or the opening degree of the valve body 41 is determined as follows.

First of all, when the electricity is not supplied to the coil 43*c* or when a duty ratio of the electricity is substantially zero percent, the valve body 41 is positioned at the most downward position in FIG. 2 by urging force downwardly generated based on an elasticity of the bellows 42*b*. Therefore, the opening degree of the valve hole 44*a* becomes a maximum value. Thereby, the pressure in the crank chamber 17 also becomes a maximum value of the pressure in the crank chamber 17 under the condition. The differential pressure between the crank chamber 17 and the compression chamber 24 which is applied to the piston 22 is relatively large. At this time, the inclination angle of the swash plate 20 becomes a minimum inclination angle relative to the plane perpendicular to the rotary axis of the drive shaft 18. Thereby, the displacement of the compressor becomes a minimum value.

Secondly, when the electricity is supplied to the coil 43*c* in the displacement control valve 33, in other words, when the duty ratio of the electricity is larger than the minimum duty ratio in a variable range of the duty ratio of zero percent, the electromagnetic force that is applied to the movable core 43*b* upwardly operates the valve body 41 in FIG. 2. At the same time, the pressing force generated based on the differential pressure applied to the bellows 42*b* downwardly operates the valve body 41 in FIG. 2. Also, urging force generated based on the elasticity of the bellows 42*b* downwardly operates the valve body 41 in FIG. 2. The valve body 41 is positioned based on the balance between the upward force and the downward force.

For example, as the rotational speed of the engine E decreases and the flow rate of the refrigerant in the refrigerant circuit decreases, the pressing force of the bellows 42*b* to the valve body 41, which is generated based on the differential pressure, decreases. Therefore, the valve body 41 upwardly moves in FIG. 2. Thereby, the opening degree of the valve hole 44*a* decreases and the pressure in the crank chamber 17 tends to decrease. At this time, the inclination angle of the swash plate 20 increases and the displacement of the compressor increases. As the displacement of the compressor increases, the flow rate of the refrigerant in the refrigerant circuit also increases and the differential pressure increases.

On the contrary, as the rotational speed of the engine E increases and the flow rate of the refrigerant in the refrigerant circuit increases, the pressing force of the bellows 42*b* to the valve body 41, which is generated based on the differential pressure, increases. Therefore, the valve body 41 downwardly moves in FIG. 2. Thereby, the opening degree of the valve hole 44*a* increases and the pressure in the crank chamber 17 tends to increase. At this time, the inclination angle of the swash plate 20 decreases and the displacement of the compressor decreases. As the displacement of the compressor decreases, the flow rate of the refrigerant in the refrigerant circuit also decreases and the differential pressure decreases.

Also, for example, as the electromagnetic force applied to the valve body 41 is increased by increasing the duty ratio of the electricity supplied to the coil 43*c*, the valve body 41 upwardly moves in FIG. 2 and the opening degree of the valve hole 44*a* decreases. Thereby, the displacement of the compressor increases. Thus, the flow rate of the refrigerant in the refrigerant circuit increases and the differential pressure also increases.

On the contrary, as the electromagnetic force applied to the valve body 41 is decreased by decreasing the duty ratio of the electricity supplied to the coil 43*c*, the valve body 41 downwardly moves in FIG. 2 and the opening degree of the valve hole 44*a* increases. Thereby, the displacement of the compressor decreases. Thus, the flow rate of the refrigerant in the refrigerant circuit decreases and the differential pressure also decreases.

That is, the pressure sensing mechanism 42 autonomously positions the valve body 41 in accordance with the variation of the differential pressure in a such manner that the displacement control valve 33 maintains a differential pressure determined by the duty ratio of the electricity supplied to the coil 43*c* or a target differential pressure. Also, the target differential pressure is heteronomously varied by adjusting the duty ratio of the electricity supplied to the coil 43*c*.

An auxiliary control mechanism of the control device will now be described with reference to FIGS. 1 through 3. The crank chamber 17 and the suction chamber 25 of the compressor are continuously in communication via the first bleed passage 31. In addition, the crank chamber 17 and the suction chamber 25 of the compressor are in communication via a second bleed passage 61. The second bleed passage 61 is formed in the housing 11 so as to pass through end surfaces between the front housing 12 and the rear housing 13. An auxiliary valve 62 is placed for opening and closing the second bleed passage 61 at the end surfaces of the front housing 12 and the rear housing 13.

That is, in an outer circumferential portion of the front housing 12 between the front housing 12 and a front end surface 13*a* of the rear housing 13, a circular valve chamber 63 in its cross section is defined. A cylindrical spool valve 64 with a bottom is accommodated in the valve chamber 63 so as to slide relative to an inner circumferential surface 63*b* of the valve chamber 63. The spool valve 64 is movable between its first position where the spool valve 64 contacts the front end surface 13*a* of the rear housing 13 as shown in FIG. 2 and its second position where the spool valve 64 contacts a bottom surface 63*a* of the valve chamber 63 at the front housing 12 side as shown in FIG. 3. By fitting the spool valve 64 in the valve housing 63, a first pressure chamber 65 and a second pressure chamber 66 are defined. The first pressure chamber 65 is defined at the right side in the valve chamber 63 in one direction of the movement of the spool valve 64 as shown in FIG. 3. The second pressure chamber 66 is defined at the left side in the valve chamber 63 in the other direction of the movement of the spool valve 64 as shown FIG. 2.

The first pressure chamber 65 and the discharge chamber 26 are in communication via a first passage 67 as a passage at a discharge chamber pressure region side. The first passage 67 is opened on the front end surface 13*a* of the rear housing 13 in the valve chamber 63. The first passage 67 constitutes a part of the supply passage 32. The displacement control valve 33 is placed in the first passage 67. That is, the refrigerant that is more downstream than the position where the displacement control valve 33 adjusts the opening degree of the valve body 41 in the supply passage 32 is introduced into the first pressure chamber 65 of the auxiliary valve 62.

The second pressure chamber 66 and the suction chamber 25 are in communication via a second passage 68 as a passage at a suction chamber pressure region side. The second passage 68 is opened on the bottom surface 63*a* of the valve chamber 63. The second passage 68 constitutes the downstream side of the second bleed passage 61. The valve chamber 63 and the crank chamber 17 are in communication via a third passage 69 as a passage at a control chamber pressure region side. The third passage 69 is opened on the inner circumferential surface 63*b* of the valve chamber 63 that slides relative to the spool valve 64 in the valve chamber 63. The third passage 69 constitutes a part of the downstream side of the supply passage 32 and the upstream side of the second bleed passage 61. That is, the third passage 69 is shared between the supply passage 32 and the second bleed passage 61.

A first communication hole 70 is formed at the first pressure chamber 65 side of the spool valve 64. The first communication hole 70 communicates with the first pressure chamber 65 while opened on the outer circumferential surface 64*a* of the spool valve 64. A second communication hole 71 is formed at the second pressure chamber 66 side of the spool valve 64. The second communication hole 71 communicates with the second pressure chamber 66 and is opened on the outer circumferential surface 64*a* of the spool valve 64. A seal ring 72 as a seal member is fixedly fitted on the outer circumferential surface 64*a* of the spool valve 64 between a first opening 70*a* of the first communication hole 70 and a second opening 71*a* of the second communication hole 71. The seal ring 72 fitted on the outer circumferential surface 64*a* of the spool valve 64 is in contact with the inner circumferential surface 63*b* of the valve chamber 63, thereby creating a seal between the first opening 70*a* and the second opening 70*a*, or between the first pressure chamber 65 and the second pressure chamber 66.

As shown in FIG. 2, in a state that the spool valve 64 is positioned at the first position, the seal ring 72 is positioned on the side of the first pressure chamber 65 relative to a third opening 69*a* of the third passage 69 while the second opening 71*a* of the second communication hole 71 communicates with the third opening 69*a* of the third passage 69. Therefore, the crank chamber 17 and the suction chamber 25 are in communication via the second bleed passage 61 which includes the third passage 69, the second communication hole 71, the second pressure chamber 66 and the second passage 68.

In the state that the spool valve 64 is positioned at the first position, the first opening 70*a* of the first communication hole 70 is closed by the inner circumferential surface 63*b* of the valve chamber 63. Therefore, the communication between the first pressure chamber 65 and the crank chamber 17 is blocked. That is, the supply passage 32 is blocked.

Figure 3:
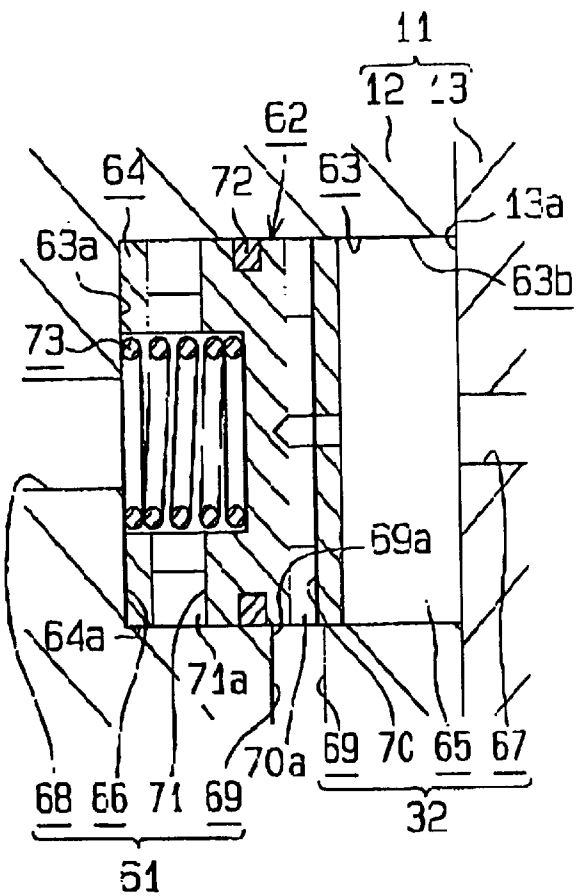
FIG. 3 is a longitudinal cross-sectional view illustrating another state of the auxiliary valve for use in the control device for the variable displacement swash plate type compressor according to the preferred embodiment of the present invention.

As shown in FIG. 3, in a state that the spool valve 64 is positioned at the second position, the seal ring 72 is positioned on the side of the second pressure chamber 66 relative to the third opening 69*a* of the third passage 69 while the first opening 70*a* of the first communication hole 70 communicates with the third opening 69*a* of the third passage 69. Therefore, the discharge chamber 26 and the crank chamber 17 are in communication via the supply passage 32 which includes the first passage 67, the first pressure chamber 65, the first communication hole 70 and the third passage 69.

In the state that the spool valve 64 is positioned at the second position, the second opening 71*a* of the second communication hole 71 is closed by the inner circumferential surface 63*b* of the valve chamber 63. Therefore, the communication between the second pressure chamber 66 and the crank chamber 17 is blocked. That is, the second bleed passage 61 is blocked.

A coil spring 73 as an urging means is interposed between the bottom surface 63*a* of the valve chamber 63 and the spool valve 64 in the second pressure chamber 66. The spring 73 urges the spool valve 64 toward the first pressure chamber 65. That is, the position of the spool valve 64 is determined by the balance between the urging force of the spring 73, the force generated based on the pressure in the suction chamber 25 introduced into the second pressure chamber 66, and the force generated based on the pressure in the first pressure chamber 65.

A characteristic operation of the auxiliary valve 62 will now be described with reference to FIGS. 2 and 3. If a predetermined time passes after the stop of the vehicle engine E, the pressure in the refrigerant circuit is equalized at relatively low pressure. Therefore, in the auxiliary valve 62, the pressure in the first pressure chamber 65 becomes equal to the pressure in the second pressure chamber 66. At this time, the spool valve 64 is positioned at the first position shown in FIG. 2 by the urging force of the spring 73 and the second bleed passage 61 is open.

Generally, in a compressor for a vehicle air conditioning apparatus, if a liquid refrigerant exists in an external refrigerant circuit 35 in a state that an engine E stops for relatively many hours, since a crank chamber 17 and a suction chamber 25 are in communication via a first bleed passage 31 and a second bleed passage 61, the liquid refrigerant flows into the crank chamber 17 through the suction chamber 25. Especially, when the temperature in a vehicle compartment is relatively high while the temperature in an engine room where the compressor is placed is relatively low, a relatively large amount of liquid refrigerant flows into the crank chamber 17 through the suction chamber 25 and remains therein.

Therefore, as the compressor, whose power transmission mechanism PT is a clutchless type mechanism, begins to be driven in accordance with starting of the engine E, rotation of a swash plate 20 and generation of heat of the engine E stir the liquid refrigerant. Thereby, the liquid refrigerant is vaporized. Consequently, the pressure in the crank chamber 17 tends to excessively rise irrespective of an opening degree of a supply passage 32 in a displacement control valve 33.

In the above-preferred embodiment, however, if the temperature in the vehicle compartment is relatively high, the air conditioner ECU 81 commands the drive circuit 82 to supply the coil 43*c* with a maximum duty ratio of the electricity such that the target differential pressure in the displacement control valve 33 is maximized at the time when the engine E is started. Therefore, as shown in FIG. 2, the displacement control valve 33 is fully closed. That is, the communication between the discharge chamber 26 and the first pressure chamber 65 in the auxiliary valve 62 is blocked by the displacement control valve 33. Thereby, the pressure in the first pressure chamber 65 is maintained to be equal to the pressure in the second pressure chamber 66.

Therefore, the spool valve 64 is maintained at the first position by the urging force of the spring 73 and the liquid refrigerant in the crank chamber 17 is promptly discharged to the suction chamber 25 through the first bleed passage 31 and the second bleed passage 61 in its vaporized state and/or its liquid state. Thereby, the pressure in the crank chamber 17 is promptly reduced after the displacement control valve 33 is fully closed. That is, the displacement of the compressor is maximized by promptly increasing the inclination angle of the swash plate 20.

Thus, while the compressor is operated and the displacement control valve 33 is fully closed, the second bleed passage 61 is opened by the auxiliary valve 62. Therefore, even if an amount of blow-by gas that is blown from the cylinder bore 14*a* to the crank chamber 17 increases in comparison with the amount of the blow-by gas that is initially designed, for example, due to abrasion of the piston 22, the blow-by gas is promptly discharged to the suction chamber 25 through the first bleed passage 31 and the second bleed passage 61. Thereby, the pressure in the crank chamber 17 is maintained to be substantially equal to the pressure in the suction chamber 25 and the maximum inclination angle of the swash plate 20, in other words, running the compressor at its maximum displacement is reliably maintained.

If the temperature in the vehicle compartment is lowered to a predetermined temperature by running the compressor at the maximum displacement immediately after the starting of the air conditioning apparatus, the air conditioner ECU 81 commands the drive circuit 82 to supply the coil 43*c* with a duty ratio of the electricity that is smaller than the maximum duty ratio of the electricity. Therefore, displacement control valve 33 is opened, and the discharge chamber 26 is opened to the first pressure chamber 65 of the auxiliary valve 62. Thereby, the pressure in the first pressure chamber 65 becomes higher than the pressure in the suction chamber 25 or the pressure in the second pressure chamber 66.

At this time, as shown in FIG. 3, the spool valve 64 is moved to the second position against the urging force of the spring 73. Therefore, the supply passage 32 between the discharge chamber 26 and the crank chamber 17 is opened while the communication of the second bleed passage 61 is blocked. That is, as the supply passage 32 is opened and the amount of the gas introduced into the crank chamber 17 is increased, the amount of the gas that is relieved from the crank chamber 17 to the suction chamber 25 is extremely decreased. Thus, the pressure in the crank chamber 17 is promptly raised and the compressor promptly decreases the inclination angle of the swash plate 20, thereby reducing its displacement.

As described above, while the compressor is operated, when the supply passage 32 in the displacement control valve 33 is open, the auxiliary valve 62 blocks the communication of the second bleed passage 61. Accordingly, an amount of the compressed refrigerant gas which leaks from the discharge chamber 26 to the suction chamber 25 through the crank chamber 17 is reduced, and deterioration of efficiency of refrigerating cycle caused due to re-expansion of the leaked refrigerant gas in the suction chamber 25 is prevented.

In the present preferred embodiment, the following effects are obtained.

(1) The second bleed passage 61 is opened and closed by the spool valve 64 of the auxiliary valve 62, while the spool valve 64 moves on the third opening 69*a* of the third passage 69. Therefore, even if the spool valve 64 leaves the second position where the auxiliary valve 62 blocks the communication of the second bleed passage 61, the second bleed passage 61 is not opened by the spool valve 64 until the spool valve 64 moves a predetermined distance and opens the third opening 69*a* of the third passage 69. Thereby, even if the spool valve 64 at the second position moves to some extent toward the first pressure chamber 65, for example, due to vibration of the compressor in accordance with the movement of the vehicle, the second bleed passage 61 is not opened. Consequently, controlling the displacement of the compressor is stabilized.

Figure 8A:
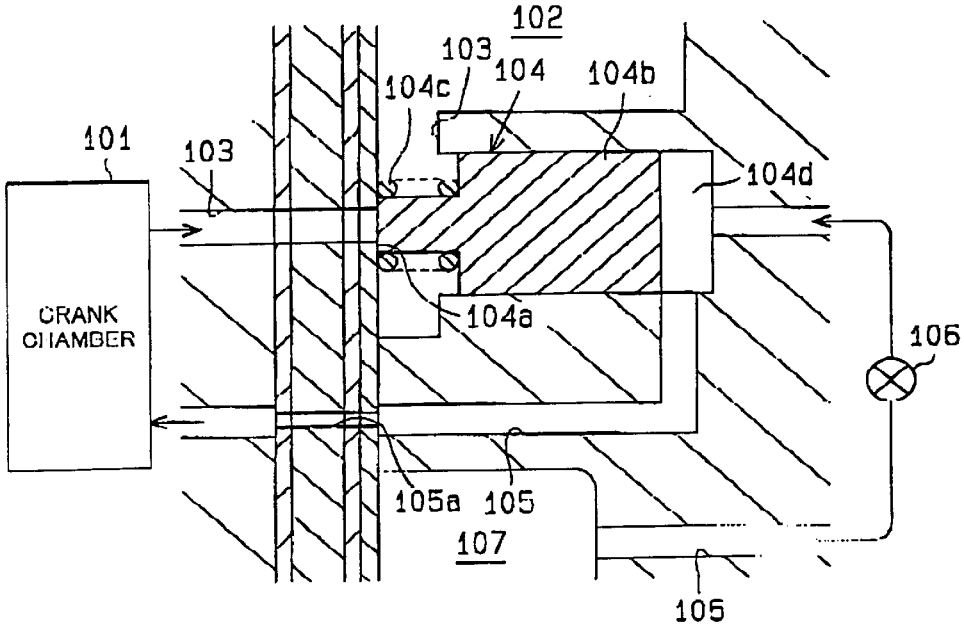
FIG. 8A (PRIOR ART)
FIG. 8A is a longitudinal cross-sectional view illustrating a state of an auxiliary valve of a control device for use in a compressor according to a prior art.
Figure 8B:
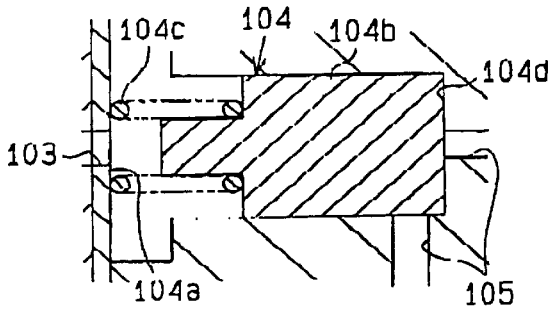
FIG. 8B (PRIOR ART)
FIG. 8B is a longitudinal cross-sectional view illustrating another sales or the auxiliary valve of the control device for use in the compressor according to the prior art.

(2) For example, an auxiliary valve 104 shown in FIGS. 8A and 8B according to a prior art is operated based on the differential pressure between the pressure of the refrigerant which is introduced into a back pressure chamber 104*d*, that is, the pressure in a space between a displacement control valve 106 and a fixed throttle 105*a* in the supply passage 105, and the pressure in a crank chamber 101 that is applied to the spool valve 104*b*. In other words, the auxiliary valve 104 is operated based on a slight fluctuation of the differential pressure between one side and the other side of the fixed throttle 105*a* that is generated due to opening and closing of the displacement control valve 106. Therefore, it is difficult to set elastic force of the spring 104*c*.

Also, when the displacement control valve 106 is open, the differential pressure between one side and the other side of the fixed throttle 105*a* is relatively small. Therefore, the spring 104*c* requires having relatively small elastic force. To ensure a predetermined stroke distance of the spool valve 104*b* by the spring 104*c* having relatively small elastic force, the diameter of the spring 104*c* is increased. That is, the size of the auxiliary valve 104 becomes relatively large.

The auxiliary valve 62 according to the present embodiment is, however, operated based on the differential pressure between the pressure of the refrigerant gas that is downward to a position where the displacement control valve 33 adjusts the opening degree of the supply passage 32, which is introduced into the first pressure chamber 65, and the pressure of the refrigerant gas in the suction chamber 25, which is introduced into the second pressure chamber 66. Therefore, the fluctuation of the differential pressure between the pressure chamber 65 and the second pressure chamber 66 caused due to the opening and closing of the displacement control valve 33 becomes relatively large. Thereby, setting the elastic force of the spring 73 becomes easy.

Also, since the differential pressure between the first pressure chamber 65 and the second pressure chamber 66 is increased while the displacement control valve 33 is open, the spring 73 whose elastic force is relatively large is adopted. The diameter of the spring 73 having relatively large elastic force is easily reduced. Thereby, the auxiliary valve 62 becomes compact and installing the auxiliary valve 62 in the housing 11 of the compressor also becomes easy.

In addition, the fixed throttle 105*a* is not required in the third passage 69 for causing differential pressure applied to the spool valve 64, which is shown in FIG. 8A. Therefore, the supply passage 32 is easily formed by machining. Thereby, manufacturing cost of the compressor is reduced.

(3) Leakage of the refrigerant gas at each portion in the auxiliary valve 62 causes deterioration of controlling the displacement of the compressor. For example, as shown in FIG. 8A, in a state that the communication of the second bleed passage 103 is blocked, a sliding portion between the spool valve 104*b* of the auxiliary valve 104 and a member for slidably supporting the spool valve 104*b*, and a portion between the spool valve 104*b* and the valve seat 104*a* have possibility for leaking the refrigerant gas. In other words, the two portions require machining in high accuracy. In the auxiliary valve 62 according to the present embodiment, however, only a sliding portion between the valve chamber 63 and the spool valve 64 has possibility for leaking the refrigerant gas. Therefore, the machining cost of the auxiliary valve 62 is reduced. Thereby, the compressor is provided relatively at a low cost.

(4) The third passage 69 is shared between the supply passage 32 and the second bleed passage 61. Therefore, the structure of the control device is simplified and the manufacturing cost of the compressor is reduced.

(5) The crank chamber 17 and the suction chamber 25 are not only in communication via the second bleed passage 61 but also in communication via the first bleed passage 31, which does not pass through the auxiliary valve 62. Therefore, while the displacement of the compressor is varied or while the second bleed passage 61 is closed, the amount of the refrigerant gas that is relieved from the crank chamber 17 to the suction chamber 25 is easily set by varying the cross sectional area of the fixed throttle 31*a* of the first bleed passage 31. Thereby, the displacement of the compressor is controlled relatively in high accuracy.

In other words, for example, while the displacement of the compressor is varied, instead of the first bleed passage 31 the refrigerant gas may be relieved from the crank chamber 17 to the suction chamber 25 by utilizing the leakage of the refrigerant gas at the sliding portion between the valve chamber 63 and the spool valve 64. In this case, the present embodiment is modified within the scope of the appended claims. At this time, the inner circumferential surface 63*b* of the valve chamber 63 and the outer circumferential surface 64*a* of the spool valve 64 require machining relatively in high accuracy.

If the auxiliary valve 62 is set such that the refrigerant gas leaks between the first pressure chamber 65 and the second pressure chamber 66, the amount of the refrigerant gas that is introduced from the discharge chamber 26 to the crank chamber 17 is reduced. Therefore, the amount of the lubricating oil that is also introduced from the discharge chamber 26 to the crank chamber 17 together with the refrigerant gas is reduced. At this time, the amount of the lubricating oil in the crank chamber 17 tends to decrease.

In the present embodiment where the first bleed passage 31 is provided while the communication between the first pressure chamber 65 and the second pressure chamber 66 are blocked, however, the amount of the refrigerant gas, which is introduced from the discharge chamber 26 to the crank chamber 17, is relatively increased. Thereby, the lubrication inside of the crank chamber 17 is satisfactorily performed.

Especially, on the spool valve 64 of the auxiliary valve 62 according to the present embodiment, a seal ring 72 is installed for creating a seal between the first pressure chamber 65 and the second pressure chamber 66. Therefore, for example, when the spool valve 64 is at the second position, the communication of the second bleed passage 61 is reliably blocked. By using the second bleed passage 61 provided with the seal ring 72 in combination with the first bleed passage 31, the displacement of the compressor is controlled further in high accuracy and the lubrication inside of the crank chamber 17 is further satisfactorily performed.

(6) The valve chamber 63 of the auxiliary valve 62 is formed at the end surfaces between the front housing 12 and the rear housing 13. Therefore, at the same time when the front housing 12 is joined to the rear housing 13, the valve chamber 63 is defined. Thereby, assembling performance for assembling the auxiliary valve 62 to the compressor is improved.

(7) When the spool valve 64 is at the first position, the second pressure chamber 66 and the third passage 69 are in communication via the second communication hole 71, which is formed inside of the spool valve 64. When the spool valve 64 is at the second position, the first pressure chamber 65 and the third passage 69 are in communication via the first communication hole 70, which is also formed inside of the spool valve 64. Therefore, the spool valve 64 is such constituted that the both ends in the direction of the movement of the spool valve 64, in other words, a portion on the side of the first pressure chamber 65 of the outer circumferential surface 64*a* and a portion on the side of the second pressure chamber 66 of the outer circumferential surface 64*a* contact the inner circumferential surface 63*b* of the valve chamber 63. Thus, the both ends of the spool valve 64 are guided by the inner circumferential surface 63*b* of the valve chamber 63. Thereby, the spool valve 64 is stably moved. Consequently, compared, to the structure where the first pressure chamber 65 and the second pressure chamber 66 directly communicate with the third passage 69 as described later referring to FIG. 4, reliability of the movement of the auxiliary valve 62 is improved.

(8) The compressor according to the present embodiment does not limit a refrigerant for use in the air conditioning apparatus. In the above-described structure, the front housing 12 is joined to the rear housing 13 to constitute the housing 11 of the compressor. That is, the two housing components constitute the housing 11. The cylinder block 14 is placed in the space defined by the front housing 12 and the rear housing 13. Therefore, the number of the end surfaces between the front housing 12 and the roar housing 13 is only two. In addition to the front housing 12 and the rear housing 13, for example, if the cylinder block 14 is also a housing component, the number of the end surfaces between the front housing 12, the rear housing 13 and the cylinder block 14 is four. Compared to the structure having four end surfaces, the structure having only two end surfaces is relatively effective to prevent the refrigerant gas from leaking. In other words, the compressor according to the present embodiment is especially structurally advantageous when carbon dioxide which requires higher pressure than flon in the compressor is adopted as a refrigerant.

In the present embodiment, the following alternative embodiments are also practiced. In the preferred embodiment, the power transmission mechanism PT is a clutchless type mechanism. In alternative embodiments to the preferred embodiment, however, the power transmission mechanism PT is a clutch type mechanism where the engine E is alternatively connected or disconnected to the compressor by an external electric control. For example, an electromagnetic clutch is adopted.

Figure 4:
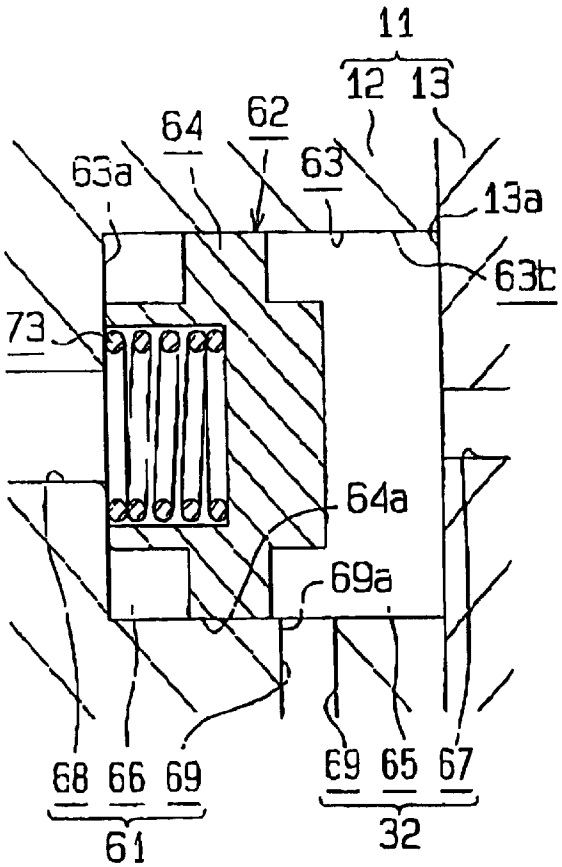
FIG. 4 is a longitudinal cross-sectional view illustrating an auxiliary valve for use in the control device of the variable displacement swash plate type compressor according to another embodiment of the present invention.
Figure 5:
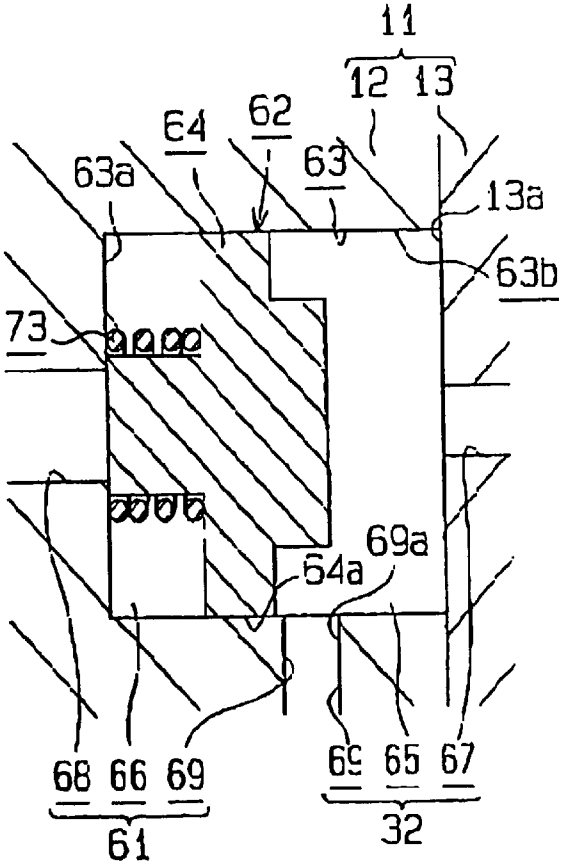
FIG. 5 is a longitudinal cross-sectional view illustrating an auxiliary valve for use in the control device of the variable displacement swash plate type compressor according to yet another embodiment of the present invention.

In the above-described preferred embodiment, the seal ring 72 is installed on the spool valve 64 of the auxiliary valve 62. In alternative embodiments to the preferred embodiment, however, as shown in FIGS. 4 and 5, the seal ring 72 is not installed on the spool valve 64. As constituted above, the number of parts of the auxiliary valve 62 is decreased. Thereby, a compressor is manufactured relatively at a low cost. In this case, if the auxiliary valve 62 is set such that the refrigerant gas positively leaks at the sliding portion between the inner circumferential surface 63*b* of the valve chamber 63 and the outer circumferential surface 64*a* of the spool valve 64, the crank chamber 17 continuously communicates with the suction chamber 25. At this time, the first bleed passage 31 is omitted.

In the above-described preferred embodiment, the spool valve 64 of the auxiliary valve 62 has the first communication hole 70 and the second communication hole 71. In alternative embodiments to the preferred embodiment, however, as shown in FIGS. 4 to 7, the first communication hole 70 and the second communication hole 71 are not formed in the spool valve 64. In addition, when the spool valve 64 is at the second position, the third passage 69 is directly open to the first pressure chamber 65. Also, when the spool valve 64 is at the first position, the third passage 69 is directly open to the second pressure chamber 66. To achieve the direct openings between the first pressure chamber 65 and the third passage 69, and between the second pressure chamber 66 and the third passage 69, the diameter of the spool valve 64 is reduced at the first pressure chamber 65 side and the second pressure chamber 66 side compared to that of the spool valve 64 at the intermediate portion between the first pressure chamber 65 side and the second pressure chamber 66 side. In this case, the spool valve 64 does not require forming the communication holes 70 and 71 therein. Thereby, the manufacturing cost of the auxiliary valve 62 is reduced.

In the above-described preferred embodiment, one end of the spring 73 is accommodated in a cylindrical space inside of the spool valve 64. In alternative embodiments to the preferred embodiment, however, as shown in FIG. 5, the spool valve 64 on the side of the second pressure chamber 66 is cylindrically formed and one end of the spring 73 is arranged at the outer circumferential side of the spool valve 64. In such a constitution, since a part of the spool valve 64 functions as a core of the spring 73, a posture of the spring 73 is stabilized and the spool valve 64 is stably moved.

Figure 6:
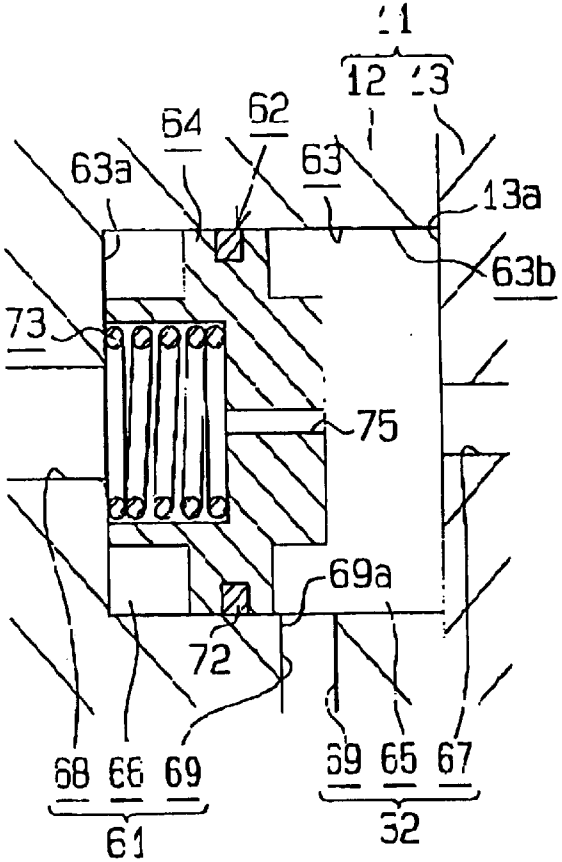
FIG. 6 is a longitudinal cross-sectional view illustrating an auxiliary valve for use in the control device of the variable displacement swash plate type compressor according to yet another embodiment of the present invention.

In alternative embodiments to the preferred embodiment, as shown in FIG. 6, a third communication hole 75 is formed in the spool valve 64 of the auxiliary valve 62. At this time, the first pressure chamber 65 and the second pressure chamber 66 are continuously in communication via the third communication hole 75. In this structure, the crank chamber 17 and the suction chamber 25 are continuously in communication via the auxiliary valve 62. Therefore, the structure of the displacement control of the compressor is simplified by eliminating the first bleed passage 31. Compared to the structure that the refrigerant gas is leaked between the inner circumferential surface 63*b* of the valve chamber 63 and the outer circumferential surface 64*a* of the spool valve 64, the amount of the refrigerant gas that is relieved from the crank chamber 17 to the suction chamber 25 is easily set.

According to the auxiliary valve 62 of the above-described preferred embodiment, when the displacement control valve 33 is fully closed, the spool valve 64 is positioned at the first position and the second bleed passage 61 is open. On the other hand, when the displacement control valve 33 is opened, the spool valve 64 is positioned at the second position and the communication of the second bleed passage 61 is blocked. That is, the auxiliary valve 62 is constituted such that the spool valve switches its position between the first position and the second position.

Figure 7:
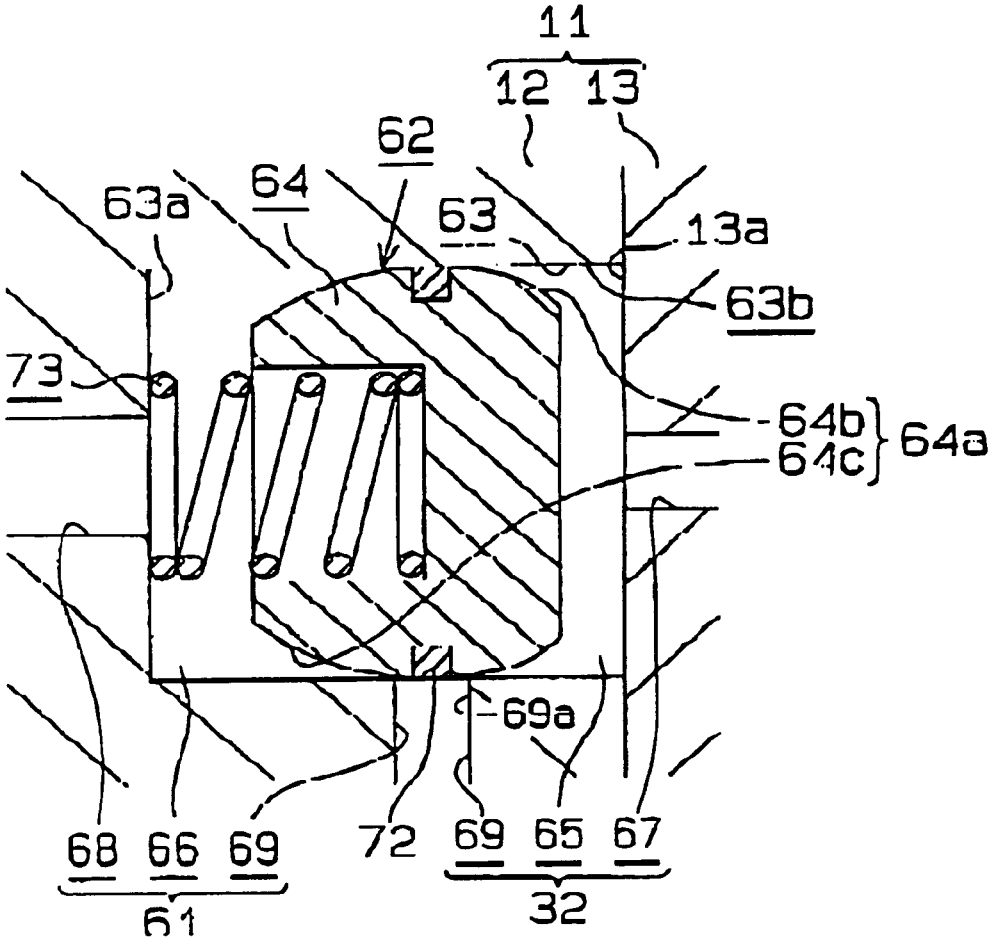
FIG. 7 is a longitudinal cross-sectional view illustrating an auxiliary valve for use in the control device of the variable displacement swash plate type compressor according to yet another embodiment of the present invention.

In alternative embodiments to the preferred embodiment, when the supply passage 32 of the displacement control valve 33 is opened at an intermediate opening degree between its fully closed position and its fully opened position, as shown in FIG. 7, the elastic force of the spring 73 is set such that the seal ring 72 is positioned above the opening 69*a* of the third passage 69. In this state, both the first pressure chamber 65 and the second pressure chamber 66 communicate with the third passage 69. Also, the outer circumferential surface 64*a* of the spool valve 64 has a first area 64*b* on the side of the first pressure chamber 65 and a second area 64*c* on the side of the second pressure chamber 66 relative to the seal ring 72. The first area 64*b* and the second area 64*c* are formed so as to become taper shape from the position of the seal ring 72 respectively toward the first pressure chamber 65 and the second pressure chamber 66.

Therefore, in a state shown in FIG. 7, if the displacement control valve 33 increases the opening degree of the supply passage 32, the spool valve 64 moves toward the second pressure chamber 66. Thereby, a first cross-sectional area of the communication between the first pressure chamber 66 and the opening 69*a* of the third passage 69 is increased and a second cross-sectional area of the communication between the second pressure chamber 66 and the opening 69*a* of the third passage 69 is decreased. At this time, the displacement of the compressor is decreased.

On the contrary, in the state shown in FIG. 7, if the displacement control valve 33 decreases the opening degree of the supply passage 32, the spool valve 64 moves toward the first pressure chamber 65. Thereby, the first cross-sectional area of the communication between the first pressure chamber 65 and the opening 69*a* of the third passage 69 is decreased and the second-sectional area of the communication between the second pressure chamber 66 and the opening 69*a* of the third passage 69 is increased. At this time, the displacement of the compressor is increased.

As described above, in the present alternative embodiments, when the displacement of compressor is varied, not only the displacement control valve 33 adjusts the opening degree of the supply passage 32 (referred to as an input control), but also the auxiliary valve 62 adjusts the opening degree of the second bleed passage 61 (referred to as an output control). Therefore, response of the displacement of compressor is improved.

Therefore, the present examples and embodiments are to be considered as illustrative and not restrictive and the invention is not to be limited to the details given herein but may be modified within the scope of the appended claims.

What is claimed is:

1. A control device for controlling displacement of a variable displacement type compressor for an air conditioning apparatus, the compressor having a suction pressure region, a discharge pressure region and a crank chamber in a housing, the displacement being variable according to the pressure in the crank chamber, the control device comprising:

a first passage defined in the housing communicating with the discharge pressure region;

a second passage defined in the housing communicating with the suction pressure region;

a third passage defined in the housing communicating with the crank chamber;

a displacement control valve placed in the first passage for adjusting an opening degree of the first passage;

an auxiliary valve placed between the suction pressure region and the crank chamber in the housing connecting the first passage and the second passage to the third passage, the auxiliary valve comprising;

a valve chamber defined in the housing, the valve chamber having an inner surface;

a spool valve accommodated in the valve chamber so as to slide relative to the inner surface, on which the third passage is open, the spool valve dividing the valve chamber into a first pressure chamber and a second pressure chamber, to communicate the first pressure chamber with the first passage and to communicate the second pressure chamber with the second passage; and an urging means placed in the valve chamber for urging the spool valve toward the first pressure chamber, wherein the third passage communicates with the first pressure chamber and/or the second pressure chamber by the movement of the spool valve due to the differential pressure between the first pressure chamber and the second pressure chamber, which varies in accordance with the opening degree of the first passage.

2. The control device according to claim 1 further comprising a first bleed passage via which the crank chamber and the suction pressure region are in communication, wherein the first bleed passage does not pass through the auxiliary valve.

3. The control device according to claim 1, wherein the auxiliary valve further comprises a seal member installed on the spool valve for creating a seal between the first pressure chamber and the second pressure chamber.

4. The control device according to claim 1, wherein the first pressure chamber and the third passage are in communication via an inside of the spool valve, and/or the second pressure chamber and the third passage being in communication via the inside of the spool valve.

5. The control device according to claim 1, wherein the housing has at least a first housing component and a second housing component joined therebetween, the valve chamber being defined on end surfaces between the first housing component and the second housing component.

6. The control device according to claim 1 wherein the compressor is a piston type compressor, the housing having a front housing and a rear housing, the front housing and the rear housing defining a space therein, the compressor having a cylinder block placed in the space, the cylinder block accommodating pistons for reciprocation.

7. The control device according to claim 6 wherein a refrigerant for the air conditioning apparatus is carbon dioxide.

8. The control device according to claim 1, wherein a diameter of the spool valve decreases from a substantially intermediate portion between the first pressure chamber side and the second pressure chamber side toward the first pressure chamber side and the second pressure chamber side.

9. The control device according to claim 8, wherein the spool valve is taper shape from the substantially intermediate portion toward the first pressure chamber side and the second pressure chamber side.

10. The control device according to claim 1, wherein the urging means is placed at an outer circumferential side of the spool valve.

11. The control device according to claim 1, wherein the urging means has an end, the end being placed inside of the spool valve.

12. The control device according to claim 1, wherein a third communication hole is formed in the spool valve, the first pressure chamber and the second pressure chamber being in communication via the third communication hole.

13. The control device according to claim 1, wherein the third passage directly communicates with the first pressure chamber or the second pressure chamber.

14. The control device according to claim 1, wherein the spool valve is switched between two positions.

* * * * *

UNITED STATES PATENT AND TRADEMARK OFFICE

CERTIFICATE OF CORRECTION

PATENT NO. : 6,733,246 B2
DATED : May 11, 2004
INVENTOR(S) : Takayuki Imai et al.

It is certified that error appears in the above-identified patent and that said Letters Patent is hereby corrected as shown below:

Column 9,
Lines 8-9, please delete "second opening 7Oa" and insert therefore -- second opening 71a --

Signed and Sealed this

Seventeenth Day of August, 2004

JON W. DUDAS
*Acting Director of the United States Patent and Trademark Office*